US008270862B2

(12) United States Patent
Hwang et al.

(10) Patent No.: US 8,270,862 B2
(45) Date of Patent: Sep. 18, 2012

(54) IMAGE FORMING APPARATUS AND METHOD FOR CONTROLLING FUSER THEREOF

(75) Inventors: Jong-In Hwang, Seoul (KR); Soo-Yong Jung, Suwon-Si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 402 days.

(21) Appl. No.: 12/605,909

(22) Filed: Oct. 26, 2009

(65) Prior Publication Data

US 2010/0178072 A1 Jul. 15, 2010

(30) Foreign Application Priority Data

Jan. 13, 2009 (KR) ..... 10-2009-0002695

(51) Int. Cl.
*G03G 15/20* (2006.01)

(52) U.S. Cl. ..... 399/69

(58) Field of Classification Search ..... 399/38, 399/67–70, 88; 219/216, 469–471
See application file for complete search history.

(56) References Cited

U.S. PATENT DOCUMENTS 7,186,956 B2 * 3/2007 Chae ..... 219/497
7,792,450 B2 * 9/2010 Takagi et al. ..... 399/69
7,933,529 B2 * 4/2011 Nakamura et al. ..... 399/69

FOREIGN PATENT DOCUMENTS

JP 2008-139505 6/2008

OTHER PUBLICATIONS

English language abstract of JP 2008-139505, published Jun. 16, 2008.
Machine English language translation of JP 2008-139505, published Jun. 16, 2008.

* cited by examiner

*Primary Examiner* — Hoan Tran
(74) *Attorney, Agent, or Firm* — Staas & Halsey LLP

(57) ABSTRACT

Disclosed is an image forming apparatus capable of controlling a fuser thereof to operate effectively even with a possible fluctuation in the AC voltage input. The image forming apparatus may include an input for receiving an AC voltage, a detector that outputs a DC voltage corresponding to a level of the AC voltage input, a fuser operable to produce heat according to the AC voltage input, a storage in which fusing temperature control information and a controller that controls the fuser using the fusing temperature control information corresponding to the DC voltage.

20 Claims, 8 Drawing Sheets

IMAGE FORMING APPARATUS AND METHOD FOR CONTROLLING FUSER THEREOF

CROSS-REFERENCE TO RELATED APPLICATIONS

This application claims priority under 35 U.S.C. §119 from Korean Patent Application No. 10-2009-02695, filed on Jan. 13, 2009, in the Korean Intellectual Property Office, the entire disclosure of which is incorporated herein by reference.

TECHNICAL FIELD

The present disclosure generally relates to an image forming apparatus and a method for controlling a fuser thereof, and more particularly, to an image forming apparatus capable of adaptively operating a fuser even when there is a change in an input AC voltage, and a method for controlling the same.

BACKGROUND OF RELATED ART

With the advancement of electronic technologies, diverse types of image forming apparatuses have been developed, and have become widespread. An image forming apparatus forms an images or text on a recording medium such as, e.g., paper. Examples of an image forming apparatus may include a printer, a copier, a facsimile machine, or a multifunctional peripheral combining some of the functions of afore-mentioned.

The image forming apparatus may employ various methods in forming an image. For example, an image forming method, often referred to as an electrophotography, may generally involve charging of a photoconductive surface, forming a latent image through light exposure of the charged surface, developing the latent image with toner into a visible toner image, transferring the developed toner image to a sheet of paper and then fusing the toner onto the sheet of paper.

The afore-mentioned fusing of the toner onto the sheet of paper is accomplished with the use of a fuser device included in an image forming apparatus employing an electrophotographic method of image forming. The fuser generally achieves the fusing of the image by applying heat and pressure to the recording medium, e.g., the sheet of paper, and thus required a supply of an electrical power of an appropriate level to enable the fuser to produce the heat.

However, the level of available alternating current (AC) power varies depending on the country or region. For example, a voltage of 220 Volts (V) is used as a standard rated voltage in Korea, whereas a voltage of 110V is used as a standard rated voltage in Japan. Further, even when the standard rated voltage were to be fixed, the input voltage may still change or fluctuate depending on the environmental condition under which the voltage is consumed.

In a typical electronic apparatus, a switching mode power supply (SMPS) may be used to convert the input AC voltage into a direct current (DC) voltage of a fixed level. A fuser device of a typical image forming apparatus, however, applies the received input AC voltage to a heating roller without first converting it into a DC voltage. Thus, a change in the input AC voltage may impact the operation of such fuser devices.

When the input AC voltage is greater than a rated voltage, the quantity of heat that is produced by the fuser may become excessively large. While known input power control schemes, e.g., by the use of a known control software, may be able to achieve control over the input voltage to some limited extent, a temperature fluctuation associated with the fuser may nevertheless become excessive, possibly resulting in an overshoot, which may in turn cause the fuser to overheat, and in some cases to fail because of such overheating.

On the other hand, when the input AC voltage is lower than the rated voltage, it may be difficult for the fuser to reach the target temperature, which may adversely impact the image fusing performance of the fuser device. Therefore, control systems for and methods of controlling an effective operation of a fuser device notwithstanding some change in an input AC voltage are desirable.

SUMMARY OF THE DISCLOSURE

According to an aspect of the present disclosure, there is provided an image forming apparatus that may comprise an input, a detector, a fuser, a storage and a controller. The input may be configured to receive an alternating current (AC) voltage. The detector may have a detector input in operable communication with the input so as to receive the AC voltage therethrough from the input and a detector output through which the detector outputs a direct current (DC) voltage corresponding to a level of the AC voltage. The fuser may be configured to receive the AC voltage and to produce heat in accordance with the AC voltage. The storage may have stored therein fusing temperature control information associated with a plurality of DC voltages. The controller may be configured to control the fuser using the fusing temperature control information in the storage associated with the DC voltage output by the detector.

The image forming apparatus may further comprise a sensor arranged in proximity of the fuser so as to senses a temperature of the fuser.

The controller may according to an embodiment be configured to output a message that indicates an error in the sensor when the temperature of the fuser as sensed by the sensor is outside a pre-determined temperature range associated with the DC voltage detected by the detector or when a gradient of the sensed temperature is outside a pre-determined gradient range associated with the DC voltage.

The controller of another embodiment may be configured to output a message that indicates an error in the sensor when the temperature of the fuser sensed by the sensor is lower than the lower limit of a pre-determined temperature range associated with the DC voltage or when a gradient of the sensed temperature is lower than the lower limit of a pre-determined gradient range associated with the DC voltage, and to control the fuser based on the fusing temperature control information stored in the storage corresponding to the sensed temperature when the sensed temperature is higher than the upper limit of the pre-determined temperature range or when the gradient of the sensed temperature is greater than the upper limit of the pre-determined gradient range.

The image forming apparatus may further comprise a fusing controller arranged between the input and the fusing device so as to selectively transmit the AC voltage from the input to the fuser. The controller may be configured output an enable signal that causes the fusing controller to transmit the AC voltage to the fuser, the controller being further configured to adjust a duty cycle of the enable signal to control the fuser.

The controller may be configured to output the enable signal with a 100% duty cycle until the temperature of the fuser reaches a first target temperature when the image forming apparatus is in a warm-up state.

Alternatively, when the AC voltage detected by the detector is greater than a rated voltage, the controller may be configured to output the enable signal at the 100% duty cycle until the temperature of the fuser reaches a set temperature that is lower than the first target temperature, and to subsequently reduce the duty cycle of the enable signal in one or more reduction steps until the temperature of the fuser reaches the first target temperature.

The controller according to an embodiment may be configured to output the enable signal at a 100% duty cycle until the temperature of the fuser reaches a first target temperature when the image forming apparatus is in a warm-up state, and, when a printing job is to be performed by the image forming apparatus, to output the enable signal at an adjusted duty cycle adjusted according to the fusing temperature control information associated with the DC voltage stored in the storage to maintain the temperature of the fuser substantially at a second target temperature.

The controller according to an embodiment may be configured, when the image forming apparatus is in a standby state, to adjust the duty cycle of the enable signal in multiple adjustment steps and to output the enable signal at each adjusted duty cycle respectively resulting from each of the multiple adjustment steps for a unit time duration when the temperature of the fuser decreases below a third target temperature within an elapse of a predetermined time period.

The controller may be configured to adjust according to the DC voltage detected by the detector at least one of respective sizes of the multiple adjustment steps, a total time duration during which the enable signal is output at adjusted duty cycles and the unit time duration during which each adjusted duty cycle is applied.

According to another aspect of the present disclosure, there is provided a method of controlling a fuser of an image forming apparatus, which method may comprise the steps of: producing a DC voltage corresponding to a level of an AC voltage input; and controlling the fuser according to pre-stored fusing temperature control information that corresponds to the DC voltage.

The method may further comprise the steps of: sensing a temperature of the fuser using a sensor; determining whether the sensed temperature is within a pre-determined range associated with the DC voltage; and outputting a message indicating an error in the sensor when the sensed temperature is outside the pre-determined range.

The method may further comprise the steps of: sensing a temperature of the fuser using a sensor; and outputting a message indicating an error in the sensor when a gradient of variation in the sensed temperature of the fuser is outside a pre-determined gradient range.

The method may further comprise sensing a temperature of the fuser using a sensor. The step of controlling the fuser may comprise the steps of: outputting a message indicating an error in the sensor when the sensed temperature is lower than the lower limit of a pre-determined temperature range associated with the DC voltage or when a gradient of variation of the sensed temperature is lower than the lower limit of a pre-determined gradient range associated with the DC voltage; and controlling the fuser according to the fusing temperature control information that corresponds to the sensed temperature when the sensed temperature is greater than the upper limit of the pre-determined temperature range or when the gradient of variation of the sensed temperature is greater than the upper limit of the pre-determined gradient range.

The step of controlling the fuser may comprise adjusting a duty cycle of an enable signal that selectively allows a transmission of the AC voltage input to the fuser.

The step of controlling the fuser may further comprise adjusting the duty cycle of the enable signal to be 100% until the temperature of the fuser reaches a first target temperature when the image forming apparatus is in a warm-up state.

The step of controlling the fuser according to an embodiment may further comprise, when the AC voltage input is greater than a rated voltage, outputting the enable signal at 100% duty cycle until the temperature of the fuser reaches a set temperature lower than a first target temperature, and subsequently reducing the duty cycle of the enable signal in multiple reduction steps until the temperature of the fuser reaches the first target temperature.

The step of controlling the fuser according to an embodiment may further comprise the steps of: outputting the enable signal at 100% duty cycle until the temperature of the fuser reaches a first target temperature when the image forming apparatus is in a warm-up state; and adjusting the duty of the enable signal according to the fusing temperature control information associated with the DC voltage to maintain the fuser substantially at a second target temperature when the image forming apparatus is performing a printing job.

The step of controlling the fuser according to an embodiment may further comprise, when the image forming apparatus is in a standby state, adjusting the duty cycle of the enable signal in multiple adjustment steps and outputting the enable signal at each adjusted duty cycle respectively resulting from each of the multiple adjustment steps for a unit time duration when the temperature of the fuser decreases below a third target temperature within an elapse of a predetermined time period.

The step of controlling the fuser according to an embodiment may further comprise, when the image forming apparatus is in a standby state, adjusting according to the DC voltage detected by the detector at least one of respective sizes of the multiple adjustment steps, a total time duration during which the enable signal is output at adjusted duty cycles and the unit time duration during which each adjusted duty cycle is applied.

BRIEF DESCRIPTION OF THE DRAWINGS

Various features and advantages of the disclosure will become more apparent by the following detailed description of several embodiments thereof with reference to the attached drawings, of which.

DETAILED DESCRIPTION OF SEVERAL EMBODIMENTS

Figure 1:
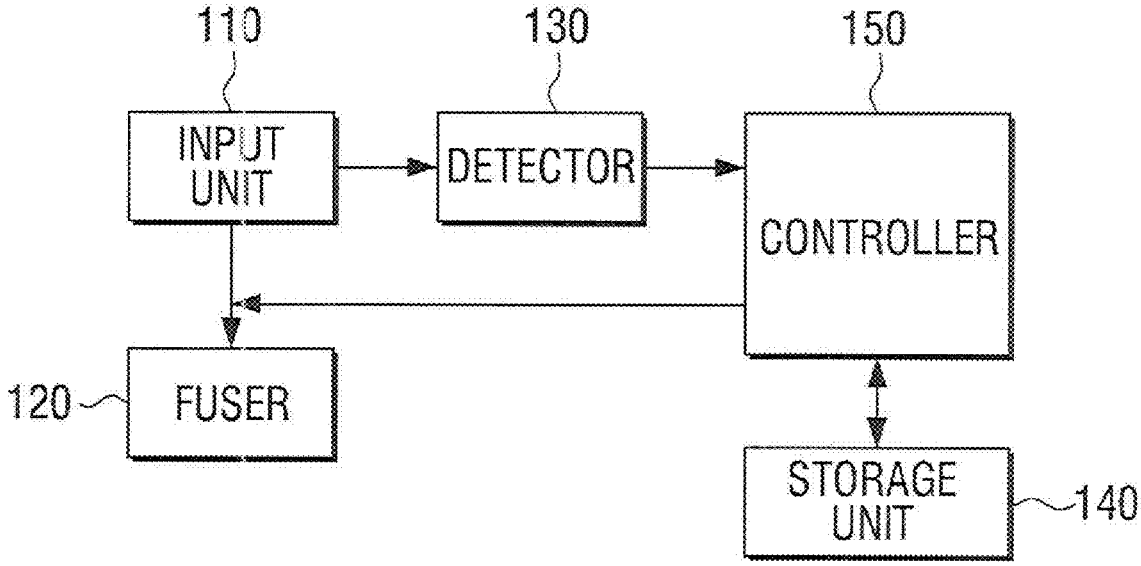
FIG. 1 is a block diagram illustrating an image forming apparatus according to an embodiment of the present disclosure.

Reference will now be made in detail to the embodiment, examples of which are illustrated in the accompanying drawings, wherein like reference numerals refer to like elements throughout. While the embodiments are described with detailed construction and elements to assist in a comprehensive understanding of the various applications and advantages of the embodiments, it should be apparent however that the embodiments may be carried out without those specifically detailed particulars. Also, well-known functions or constructions will not be described in detail so as to avoid obscuring the description with unnecessary detail. It should be also noted that in the drawings, the dimensions of the features are not intended to be to true scale and may be exaggerated for the sake of allowing greater understanding.

FIG. 1 is a block diagram illustrating an image forming apparatus according to an embodiment of the present disclosure. Referring to FIG. 1, an image forming apparatus may include an input unit 110, a fuser 120, a detector 130, a storage unit 140 and a controller 150.

The input unit 110 may be configured to receive an AC voltage from an external power source.

The fuser 120 may be driven or operable by an AC voltage received from the input unit 110. As known to those skilled in the art, the fuser 120 may include a heating roller (not shown) and a pressure roller (not shown) opposingly facing and pressing against the heating roller.

The detector 130 may produce and detect a DC voltage having a level that corresponds to a level of the input AC voltage. More specifically, the detector 130 may use a rectifying circuit and a smoothing circuit (not shown) to output a DC voltage level corresponding to the level of the input AC voltage. According to some embodiments, the detector 130 may be disposed inside a switching mode power supply (SMPS), as will be described in greater detail below with reference to FIG. 2.

The storage unit 140 may store fusing temperature control information for each level of the DC voltage. The fusing temperature control information refers to information used for controlling the state of the AC voltage supplied to the fuser 120. For example, the fusing temperature control information may include information for controlling the time periods during which the AC voltage is selectively supplied or interrupted to the fuser 120.

The fusing temperature control information may be obtained, for example, empirically through an experiment in which a varying level of the AC voltage is input, the resultant DC voltage level is detected, and in which determination and/or correlation of an optimal fusing temperature control information for the DC voltage level may be made. For example, when an AC voltage greater than the rated voltage is input, the degree of overshoot or the degree of target temperature reference voltage fluctuation may be mitigated by turning the fuser 120 on for a shorter time duration than when the proper rated voltage is input. On the other hand, when an AC voltage lower than the rated voltage is input, the turn-on time of the fuser 120 may be made to be longer than the turn-on time of the fuser when the rated voltage is input until the temperature of the fuser 120 reaches a target temperature. In this manner, the optimal turn-on time duration may be determined in corresponding relation to the various detected DC voltage levels may be obtained as an example of the fusing temperature control information.

The controller 150 may obtain, from the storage unit 140, for example, the fusing temperature control information corresponding to the level of the DC voltage detected by the detector 130. The controller 150 may control the fuser 120 according to the fusing temperature control information. More specifically, the controller 150 may adjust the supply and/or interruption state of the AC voltage to the fuser 120 to obtain the voltage conditions that are similar to when the rated voltage had been input. As a result, the fusing performance may be maintained even when there is a change in the input voltage, and, thus the likelihood of damages to the fuser may be prevented or minimized.

Figure 2:
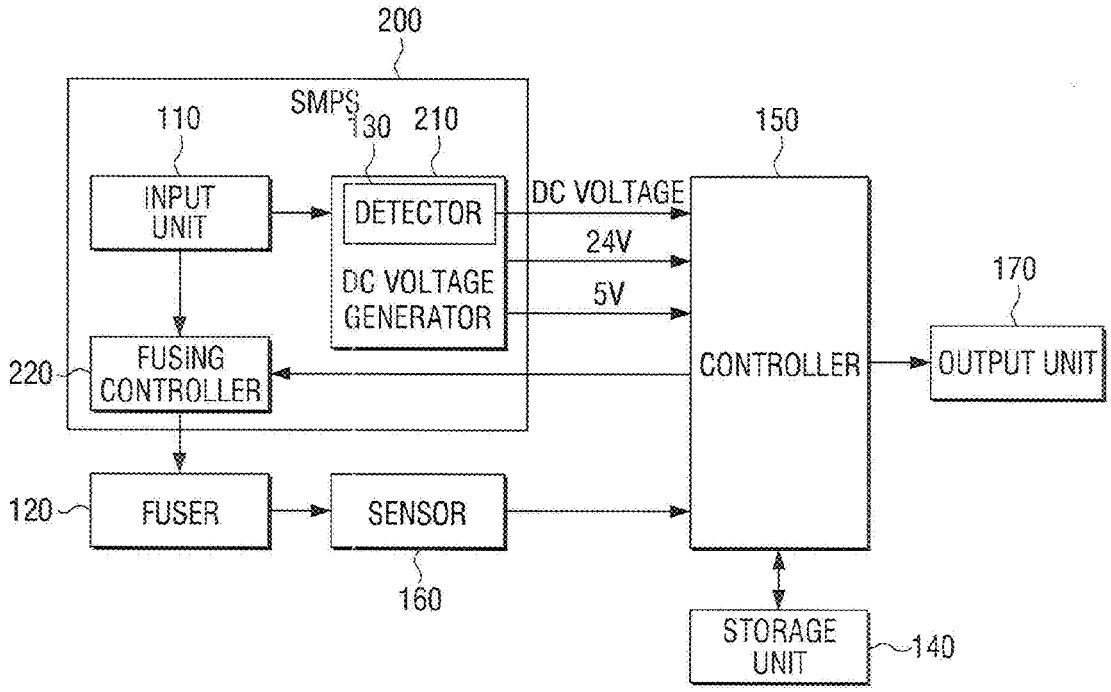
FIG. 2 is a block diagram illustrating an image forming apparatus according to another embodiment of the present disclosure.

FIG. 2 is a block diagram illustrating an image forming apparatus according to another embodiment of the present disclosure. Referring to FIG. 2, an image forming apparatus according to an embodiment may further include a sensor 160, an output unit 170 and a fusing controller 220, in addition to the input unit 110, the fuser 120, the detector 130, the storage unit 140, and the controller 150 of FIG. 1.

The detector 130 may be disposed inside a DC voltage generator 210. Moreover, the input unit 110, the DC voltage generator 210 and the fusing controller 220 may be arranged to be functional components of an SMPS 200.

The SMPS 200 of FIG. 2 may be used in the image forming apparatus described in FIG. 1. That is, FIG. 1 may further include the fusing controller 220 and the DC voltage generator 210. It should be noted that the configuration shown in FIG. 2 is merely an example, and that the respective components shown may be arranged in a different manner. It should also be noted that the components illustrated in FIG. 2 are shown for the purpose of the convenience of describing various components that can be employed, and that at least some of the components shown in FIG. 2 may be omitted or additional component(s) may be added in various alternative embodiments.

The fusing controller 220 may transmit an AC voltage input provided through the input unit 110 to the fuser 120. While for the sake of brevity, the connections between the input unit 110 and the fuser 120 through the fusing controller 220 are shown as a single and/or unidirectional connection line in FIG. 2, it should be understood that the connections may be made through any number of connection lines, and can be made bidirectionally. For example, the fusing controller 220 may be connected to the input unit 110 and the fuser 120 through two connection lines, to transmit the AC voltage. In addition, the fusing controller 220 may include a switch (not shown) disposed in one or more of the connection lines to selectively affect the connection(s). The switch may be, for example, a transistor-based switch, and may receive a control signal to control the operation of the switch. For example, the switch may receive a switching or enabling signal from the controller 150.

According to an embodiment, and as depicted in FIG. 2, the detector 130 may be arranged to be a part of the DC voltage generator 210. The DC voltage generator 210 may convert an AC voltage input received from the input unit 110 into one or more DC bias voltages (e.g. 24V, 5V), and may output such DC bias voltages for use by various components of the image forming apparatus. To that end, the DC voltage generator 210 may include a rectifying circuit, a smoothing circuit, and/or a transformer for such AC to DC conversion as is known in the art. According to an embodiment, the detector 130 may be configured to detect the primary voltage of a transformer to thereby obtain a DC voltage level corresponding to the input AC voltage. So obtained DC voltage may be supplied to the controller 150. The controller 150 may obtain from the storage unit 140 the appropriate fusing temperature control information corresponding to the level of the DC voltage received from the DC Voltage generator 210. Accordingly, the controller 150 may output to the fusing controller 220 control signal(s) according to the fusing temperature control information, and may thereby control the fuser 120.

The storage unit 140 may store the fusing temperature control information in one or more ways, an illustrative example of which is shown in Table 1 below:

TABLE 1

| DC Level | Input AC voltage | Voltage | Control Method |
|---|---|---|---|
| 0 V | −30% of a rated voltage | 220 V*0.7 | A |
| . . . | . . . | . . . | . . . |
| . . . | −20% of a rated voltage | 220 V*0.8 | . . . |
| . . . | . . . | . . . | . . . |
| . . . | −10% of a rated voltage | 220 V*0.9 | . . . |
| . . . | . . . | . . . | . . . |
| 1.65 V | Rated voltage | 220 V*1 | . . . |
| . . . | . . . | . . . | . . . |
| . . . | 10% of a rated voltage | 220 V*1.1 | . . . |
| . . . | . . . | . . . | . . . |
| . . . | 20% of a rated voltage | 220 V*1.2 | . . . |
| . . . | . . . | . . . | . . . |
| 3.3 V | 30% of rated voltage | 220 V*1.3 | Z |

The voltages in Table 1 are examples of the actual level of the input AC voltage. Table 1 shows examples of various types of information that may be included in the fusing temperature control information, including, e.g., the level of the DC voltage, the proportional relationship of the input AC voltage with respect the rated voltage, the actual voltage and the control method corresponding to the DC voltage level. It should be noted however that not all types of the information of Table 1 need be recorded or stored in the storage unit 140. For example, the fusing temperature control information recorded or stored in the storage unit 140 may only include the DC level and the corresponding control method informational types.

The control method may include or identify data and/or algorithm that defines or relating to, for example, duty cycles or periods of the enable signal used to control the fuser 120 according to the temperature of the fuser 120.

An illustrative example of the control method according to an embodiment is shown below in Table 2:

TABLE 2

| Fuser Temperature | −10% of rated voltage | Rated Voltage | +10% of a rated voltage |
|---|---|---|---|
| Above T + 2° C. | 10% duty cycle | Off | Off |
| T + 1° C.~T + 2° C. | 25% duty cycle | 25% duty cycle | 10% duty cycle |
| T~T + 1° C. | 33% duty cycle | 33% duty cycle | 25% duty cycle |
| T − 2° C.~T | 50% duty cycle | 50% duty cycle | 33% duty cycle |
| T − 5° C.~T − 2° C. | 75% duty cycle | 66% duty cycle | 50% duty cycle |
| T − 8° C.~T − 5° C. | 100% duty cycle | 75% duty cycle | 75% duty cycle |
| Below T − 8° C. | 100% duty cycle | 100% duty cycle | 100% duty cycle |

In Table 2, the "T" refers to the target temperature. That is, when the temperature of the fuser 120 is higher than the target temperature by a predetermined temperature, the fuser 120 may typically be turned off. However, if the fuser 120 is completely turned off when the input voltage is lower than the rated voltage, it may difficult to maintain the target temperature. Accordingly, if the input voltage is lower than the rated voltage, the fuser 120 may be turned on for some fraction of the time, e.g., 10%. For example, using 100 seconds as a reference time unit, the fuser 120 may be turned on for about 10 seconds of every 100 seconds.

When the temperature is lower than the target temperature by a predetermined temperature, for example, when the temperature is below T−8 degrees Celsius (° C.), the duty cycle may be maintained at 100% so that the temperature may rapidly reach the target temperature.

The controller 150 may control the fuser 120 using the fusing temperature control information shown in Table 2.

The fuser 120 may be controlled in different ways depending on the current state of the image forming apparatus. For example, when the image forming apparatus is turned on, the image forming apparatus may initially be in a warming up state for some duration of time prior to entering a standby states, in which state, when a printing job request is received, a printing operation is performed. The various operational states of an image forming apparatus may be categorized into three general states, namely, a warm-up state, a printing state and a standby state. The printing state may refers to, but need not be limited to, a time duration from a point in time at which a print command is received by the image forming apparatus to a point in time at which a printing job is completed. The printing state may alternatively refer to a time during which a printing operation is actually performed.

Because the temperature of the fuser 120 is low during the warm-up state, the controller 150 may output an enable signal that results in a 100% duty cycle until the temperature reaches a predetermined target temperature (hereinafter, a first target temperature). When the temperature reaches the first target temperature, the controller 150 may reduce the duty cycle of the enable signal, thereby maintaining the first target temperature.

On the other hand, during the printing state, the controller 150 may output the enable signal while adjusting the duty cycle appropriately according to the fusing temperature control information corresponding to the level of the input AC voltage such that the fuser 120 maintains a fusing temperature (hereinafter, a second target temperature) suitable for the printing operation. The fusing temperature control information may be differently set depending on the level of the input AC voltage as described above.

In the standby state, after the warm-up state and before the printing operation, the fuser 120 may maintain a predetermined temperature (hereinafter, a third target temperature) so as to be able to perform the printing operation with sufficient immediacy upon a print command. Accordingly, even in the standby state, the controller 150 may need to appropriately control the fuser 120. Such control of the fuser 120 is described in greater detail below.

Referring back to FIG. 2, the sensor 160 may sense the temperature of the fuser 120, and may provide the sensed temperature to the controller 150. The sensor 160 may be, for example, a thermistor. The controller 150 may output an enable signal having an appropriate duty cycle with reference to the control information, e.g., as illustrated in Table 2, based on the temperature sensed by the sensor 160.

However, when there is a defect in the sensor 160 or a problem during the manufacturing or assembly of the sensor 160, such as, for example, the sensor 160 becoming separated from the fuser 120, the temperature of the fuser 120 that is erroneously sensed by the sensor 160 may be lower than the actual temperature. In this case, a conventional image forming apparatus may incorrectly determine that the temperature of the fuser 120 is lower than the target temperature, and may continue to supply an AC voltage to raise the temperature of the fuser 120 to the target temperature. This may result in a damage to the fuser 120 or may even cause a fire. On the other hand, when the temperature of the fuser 120 as sensed by the sensor 160 is erroneously higher than the actual temperature because of the defect or problem associated with the sensor 160, a conventional image forming apparatus may incorrectly decide that the temperature of the fuser 120 is higher than the target temperature, and may attempt to lower the temperature, likely resulting in a poor fusing performance.

To address the issues described above, according to an embodiment, the controller 150 may perform a diagnosis to determine whether the temperature sensed by the sensor 160 or the gradient of the temperature variation is allowable or expected, and may display a result of the diagnosis through the output unit 170. The output unit 170 may be, for example, a display element or a speaker that is provided with the image forming apparatus.

For example, when the sensed temperature is out of the allowable range, that is, when the temperature is lower or higher than the allowable range, the controller 150 may control the output unit 170 to display an error message.

As an alternative example, when the sensed temperature is lower than the allowable range, the controller 150 may control the output unit 170 to display an error message, and, when the sensed temperature is higher than the allowable range, the controller 150 may compensate the amount of heat produced by the fuser 120 using the fusing temperature control information corresponding to the level of the current DC voltage, instead of or in addition to displaying an error message. That is, when the sensed temperature is lower than the allowable range, the controller 150 may continue to drive the fuser 120 to reach a target temperature, and accordingly, may notify of a possible danger of damage to the fuser 120 and/or of a fire by displaying an error message. However, when the sensed temperature is greater than the allowable range, because no such danger exists, the image forming apparatus may be allowed to continue to operate with the amount of heat produced by the fuser 120 compensated to improve the fusing performance.

As another example, the gradient of the variation of the sensed temperature may be examined, and if such gradient is out of allowable or expected gradient range, the controller 150 may display an error message. That is, the error message may be displayed if the gradient is small or greater than the allowable gradient range.

As yet another example, the controller 150 may display an error message only when the gradient of the variation of the sensed temperature is lower than the allowable range, and may compensate the amount of heat produced in the fuser 120 according to the fusing temperature control information when the gradient is greater than the allowable range.

As described above, according to embodiments of the present disclosure, various error conditions may be diagnosed based on different sets of criteria. Such a diagnosing operation may also be performed during the warm-up process.

Figure 3:
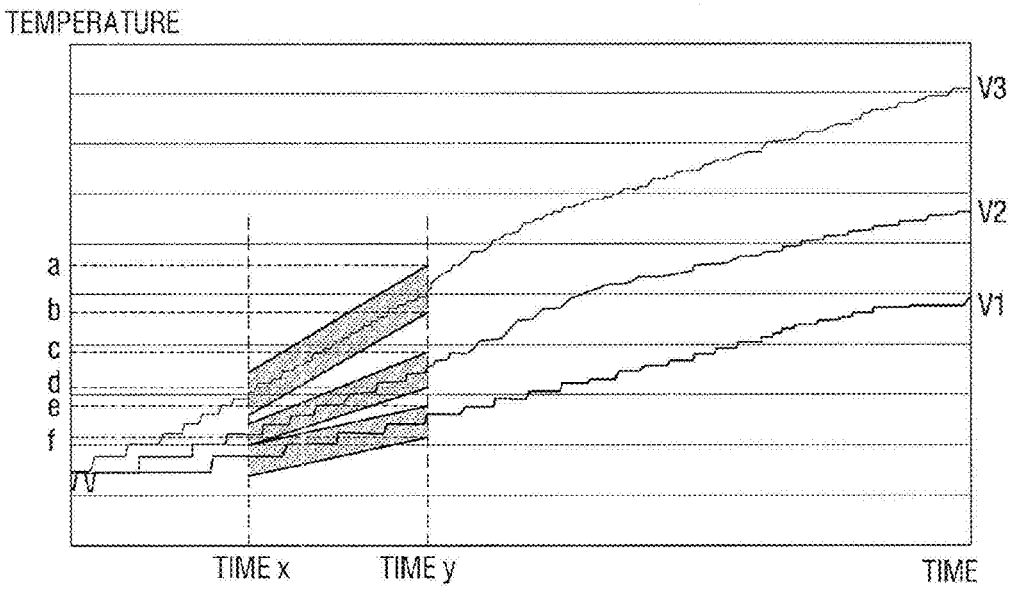
FIG. 3 is a view to explain an example of a process of diagnosing an error.

An illustrative example of the error diagnosing operation of the sensor 160 during the warm-up period of the image forming apparatus is shown in FIG. 3. In the example shown in FIG. 3, the horizontal axis represents the time and the vertical axis represents the temperature of the fuser 120, for the sake of convenience, specific values for which are not shown.

Because the enable signal may be output with a 100% duty cycle during the warm-up period as previously described, the temperature of the fuser 120 may rise in a stepwise fashion. FIG. 3 illustrates graphs V1, V2, and V3, each associated with a different input AC voltage level. In the example shown, V2 is the rated voltage (Vr) whereas V1 is −30% of the rated voltage (i.e., 0.7 Vr), and V3 is +30% of the rated voltage (i.e., 1.3 Vr).

Referring to FIG. 3, at a given point in time, when the level of the AC voltage increases, the temperature may also correspondingly rise. The temperature associated with each input AC voltage level becomes different at a predetermined time, such as time "y", for example. Through repetitive experiments and/or through a predictive analysis with respect to the corresponding relationship between the elapsed time and the temperature rise, the allowable temperature range associated with each of several input AC voltages may be determined. For example, in the case of V3, the temperature at the time "y" may be within a range having the maximum temperature "a" ° C. and a minimum temperature "b" ° C. In the case of V2, the temperature at time "y" may be within a range having a maximum temperature "c" ° C. and a minimum temperature "d" ° C. In the case of V1, the temperature at time "y" may be within a range having a maximum temperature "e" ° C. and a minimum temperature "f" ° C.

When the sensed temperature falls within the allowable range, the controller 150 may recognize that the sensor 160 is operating normally. On the other hand, when the sensed temperature is out of the allowable range, the controller 150 may recognize that the sensor 160 may be malfunctioning.

The presence or absence of an error may be diagnosed by checking the gradient of the temperature variation. That is, the controller 150 may check the variation in the temperature during the time interval between time "x" and time "y" and may determine the presence or absence of an error according to whether the variation is out of the allowable gradient range.

Because the criterion for determining the presence of an error and the subsequent process to address the error are described above, a detailed description thereof will not be repeated. The allowable temperature range or the allowable gradient range may be determined empirically and/or analytically as described above, and may be stored in the storage unit 140.

Figure 4:
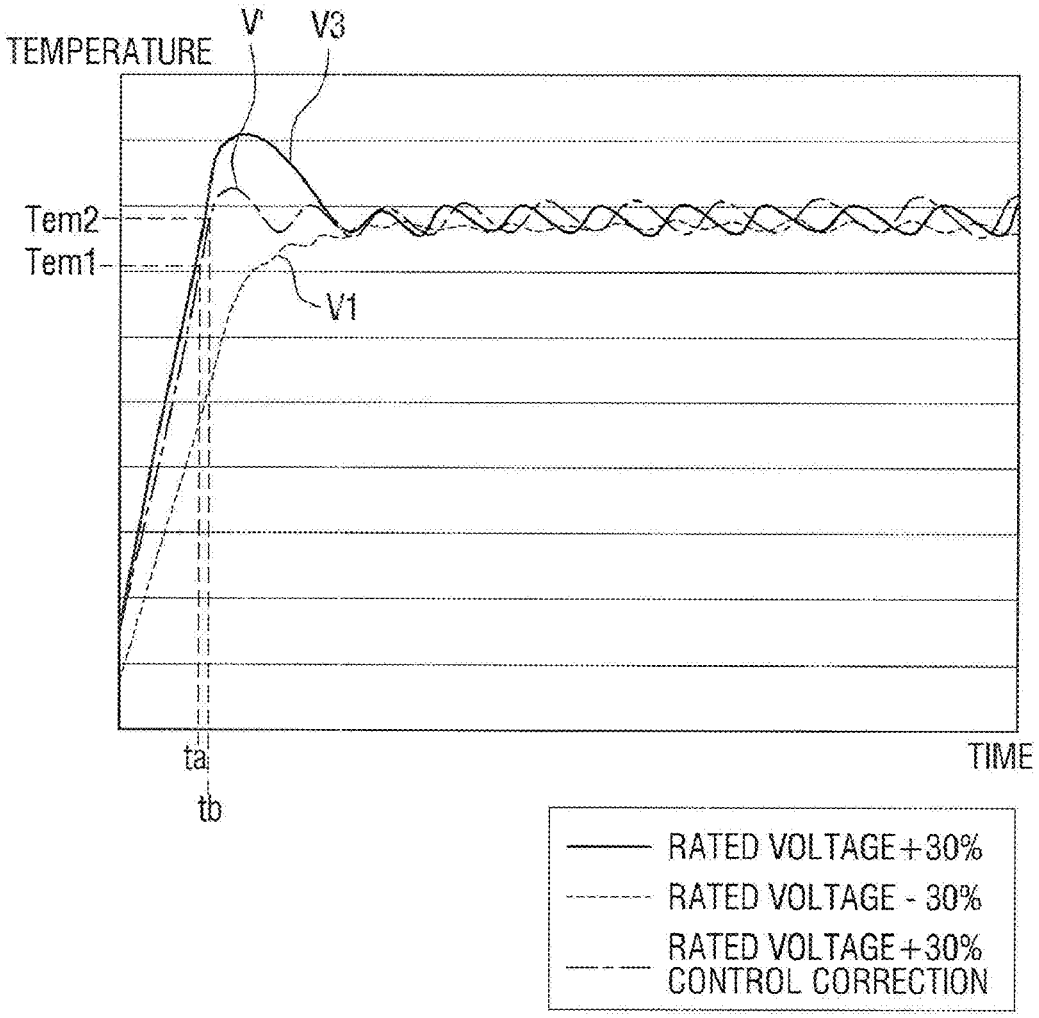
FIG. 4 is a view to explain an example of a process of controlling a voltage of the image forming apparatus to reduce overshoot.

FIG. 4 is illustrative of a process of controlling voltages in a standby state of the image forming apparatus according to an embodiment of the present disclosure.

In FIG. 4, V1 represents the variation in the temperature of the fuser 120 when an AC voltage of −30% of the rated voltage (i.e., 0.7 Vr) is provided, V3 represents the variation in the temperature of the fuser 120 when an AC voltage of +30% of the rated voltage (i.e., 1.3 Vr) is provided, and V' represents the variation in the temperature of the fuser 120 to which a process of removing an overshoot according to an embodiment is applied when the AC voltage of +30% of the rated voltage (i.e., 1.3 Vr) is provided.

Referring to FIG. 4, when the image forming apparatus is turned on, it warms up for a predetermined time "tb" and then enters a standby state. In the standby state, a third target temperature "Tem 2" is maintained.

As described above, the controller 150 may set the duty cycle of the enable signal to 100% during the warm-up period, that is, until the temperature reaches a first target temperature. Depending on the particular design of the image forming apparatus, the first target temperature may be less than or greater than the third target temperature or may be equal to the third target temperature.

However, in the case of V3 in which the input AC voltage is greater than the rated voltage, when the duty cycle remains 100% until the temperature reaches the first target temperature, the temperature may exceed the third target temperature when the image forming apparatus enters the standby state, that is, a temperature overshoot may occur.

To prevent the overshoot, the controller 150 may determine whether the overshoot will occur or not during the warm-up period. The occurrence of an overshoot may be determined by checking the level of the input voltage. For example, when the DC level of the input voltage is greater than the DC level of the rated voltage, the input AC voltage may be recognized as being greater than the rated AC voltage.

In the case of V3, because it may be predicted that the overshoot will occur, the duty cycle may be reduced at a temperature (Tem 1) lower than the first target temperature. The resulting variation in the temperature of the fuser 120 is illustrated as V'. As a result, the amount of heat of the fuser 120 may be reduced in advance during the time interval between time "ta" and time "tb" and before the temperature reaches the first target temperature so that the temperature is prevented from exceeding the first target temperature.

In FIG. 4, the duty cycle may be reduced one time at the time "ta," or it may be reduced several times in a stepwise fashion, for example. That is, when the temperature reaches a set temperature "Tem 1", the duty cycle may be reduced to 80%, and when the temperature reaches a next set temperature, the duty cycle may be further reduced to 50% such that the temperature may more gradually reach the third target temperature "Tem 2".

Figure 5:
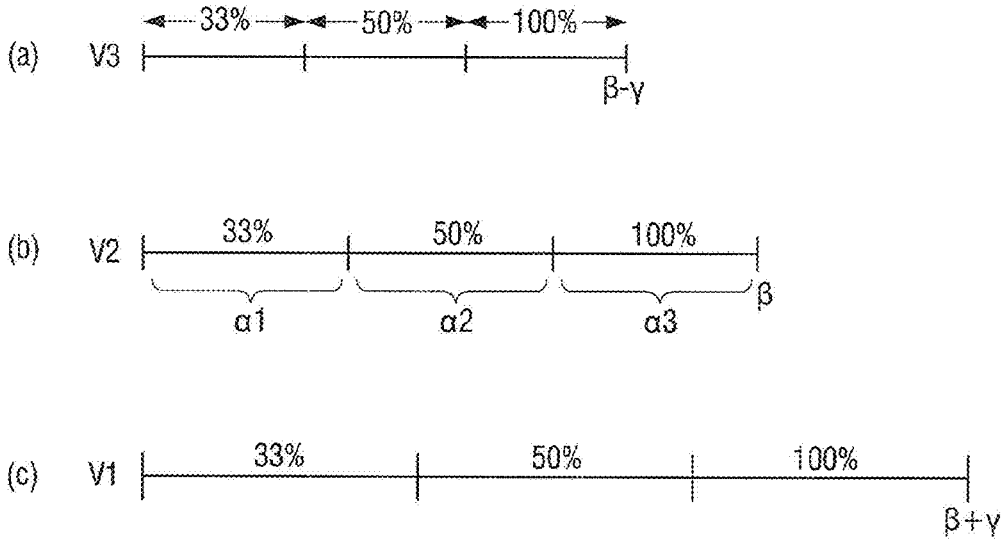
FIG. 5 is a view to explain an example of a process of controlling a fuser during a standby state period.

FIG. 5 is illustrative of an example of a process of controlling the temperature of the fuser in the standby state according to an embodiment.

As described above, the image forming apparatus may maintain a predetermined target temperature (third target temperature) in the standby state, from which state, the image forming apparatus may perform a printing job sufficiently immediately upon receipt of a print command. To maintain such a third target temperature, the controller 150 may control the temperature of the fuser 120 in various ways.

For example, the controller 150 may control the temperature of the fuser 120 in the same way as that during the printing period. That is, the controller 150 may monitor the sensing result of the sensor 160, and may increase or reduce the duty cycle respectively when the temperature is below or above the third target temperature.

Alternatively, the controller 150 may control the temperature of the fuser 120 in a pre-set duty cycle pattern for a predetermined time when the temperature of the fuser 120 decreases below the third target temperature. An example of the duty cycle pattern according to an embodiment is illustrated in FIG. 5.

In FIG. 5, when the input voltage is the rated voltage V2, the fuser 120 may be enabled for the time as shown in the graph (b). In this case, the duty cycle of the enable signal may be changed stepwise. For example, the duty cycle may be changed in three stages, such as by 33% during a time interval $\alpha 1$, by 50% during a time interval $\alpha 2$, and by 100% during a time interval $\alpha 3$, where $\alpha 1+\alpha 2+\alpha 3=\beta$.

In graph (b) of FIG. 5, each of the time intervals $\alpha 1$, $\alpha 2$ and $\alpha 3$ are shown to have substantially the same duration, but those time intervals may be variable, and may be set independently of one another.

When the input AC voltage is V3, which may be greater than V2, the time required to enable the fuser 120 may be reduced to $\beta-\gamma$. Because the temperature of the fuser 120 increases within a relatively shorter amount of time when the input AC voltage is larger, the amount of temperature ripple or fluctuation may become greater when the fuser 120 is enabled for the same duration of time. Therefore, the temperature ripple may be reduced by reducing the total time during which the fuser 120 is enabled. In this case, the duty cycle of the enable signal may be maintained as it is. That is, the controller 150 may output enable signals with duty cycles of 33%, 50%, and 100%, respectively, for new time intervals $\alpha 1'$, $\alpha 2'$, and $\alpha 3'$, where $\alpha 1'+\alpha 2'+\alpha 3'=\beta-\gamma$.

The graph (c) of FIG. 5 illustrates the case in which the AC voltage is V1, which is lower than the rated voltage V2. As shown in the graph (c), in such a situation, the total time during which to enable the fuser 120 may be $\beta+\gamma$. The controller 150 may output the enable signals with duty cycles of 33%, 50%, and 100%, respectively, for new time intervals $\alpha 1''$, $\alpha 2''$, and $\alpha 3''$, where $\alpha 1''+\alpha 2''+\alpha 3''=\beta+\gamma$.

Although the total enabling time may be adjusted according to the level of the input AC voltage as shown in FIG. 5, in other embodiments, the total enabling time may be fixed while the duty cycle pattern may instead be changed.

That is, when V3 greater than the rated voltage V2 is input, the time interval $\alpha 3$ during which the enable signal is output with a 100% duty cycle may be reduced and the time interval $\alpha 1$ may be increased so that the temperature ripple may be minimized. On the other hand, when V1 less than the rated voltage V2 is input, the duty cycle pattern may be adjusted in a manner that increases the time interval $\alpha 3$ and reduces the time interval $\alpha 1$.

Although the duty cycle patterns are shown to include duty cycles of 33%, 50% and 100%, and shown to change in that order in FIG. 5, such specific values and order are not intended to be limiting. The duty cycle may be provided in any pattern that may minimize the temperature ripple.

Figure 6:
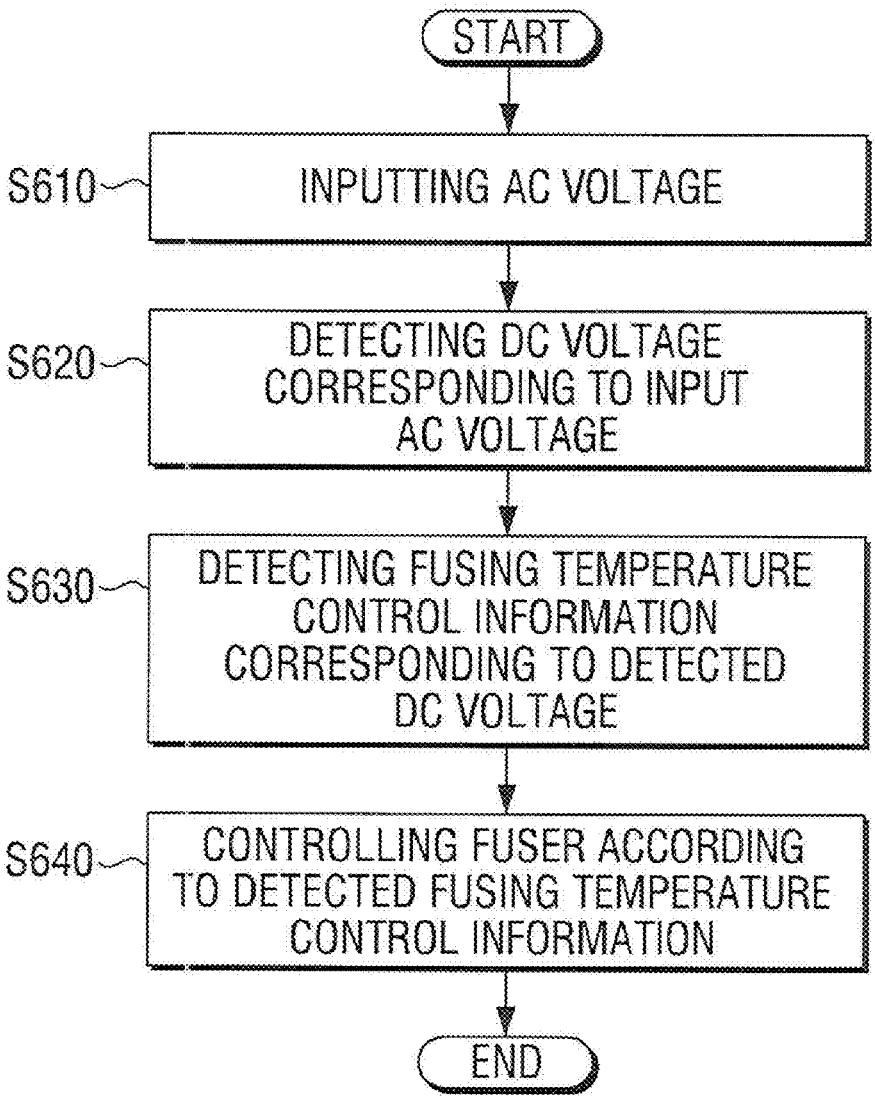
FIG. 6 is a flowchart illustrating a method for controlling a fuser of an image forming apparatus according to an embodiment of the present disclosure.

FIG. 6 is a flowchart illustrating a method for controlling the fuser of the image forming apparatus according to an embodiment of the present disclosure.

Referring to FIG. 6, when an AC voltage is input (S610), a DC voltage corresponding to the input AC voltage may be detected (S620). As previously described, the DC voltage corresponding to the input AC voltage may be detected by, for example, the SMPS 200 of FIG. 2.

The fusing temperature control information corresponding to the detected DC voltage may then be retrieved from the information pre-stored, e.g., in the storage unit 140 (S630). The fusing temperature control information may include different types of data for controlling the temperature of the fuser 120. For example, the fusing temperature control information may include information regarding the duty cycle of an enable signal used to control a switch that switches to transmit or interrupt the transmission of input AC voltage to the fuser 120.

The fuser 120 may be controlled according to the detected fusing temperature control information (S640). That is, when the input AC voltage is greater than the rated voltage, the duty cycle may appropriately be reduced so that the temperature ripple and/or the overshooting of a target temperature may be prevented. On the other hand, when the input AC voltage is lower than the rated voltage, the duty cycle may be increased so that the intended fusing performance may be realized.

Figure 7:
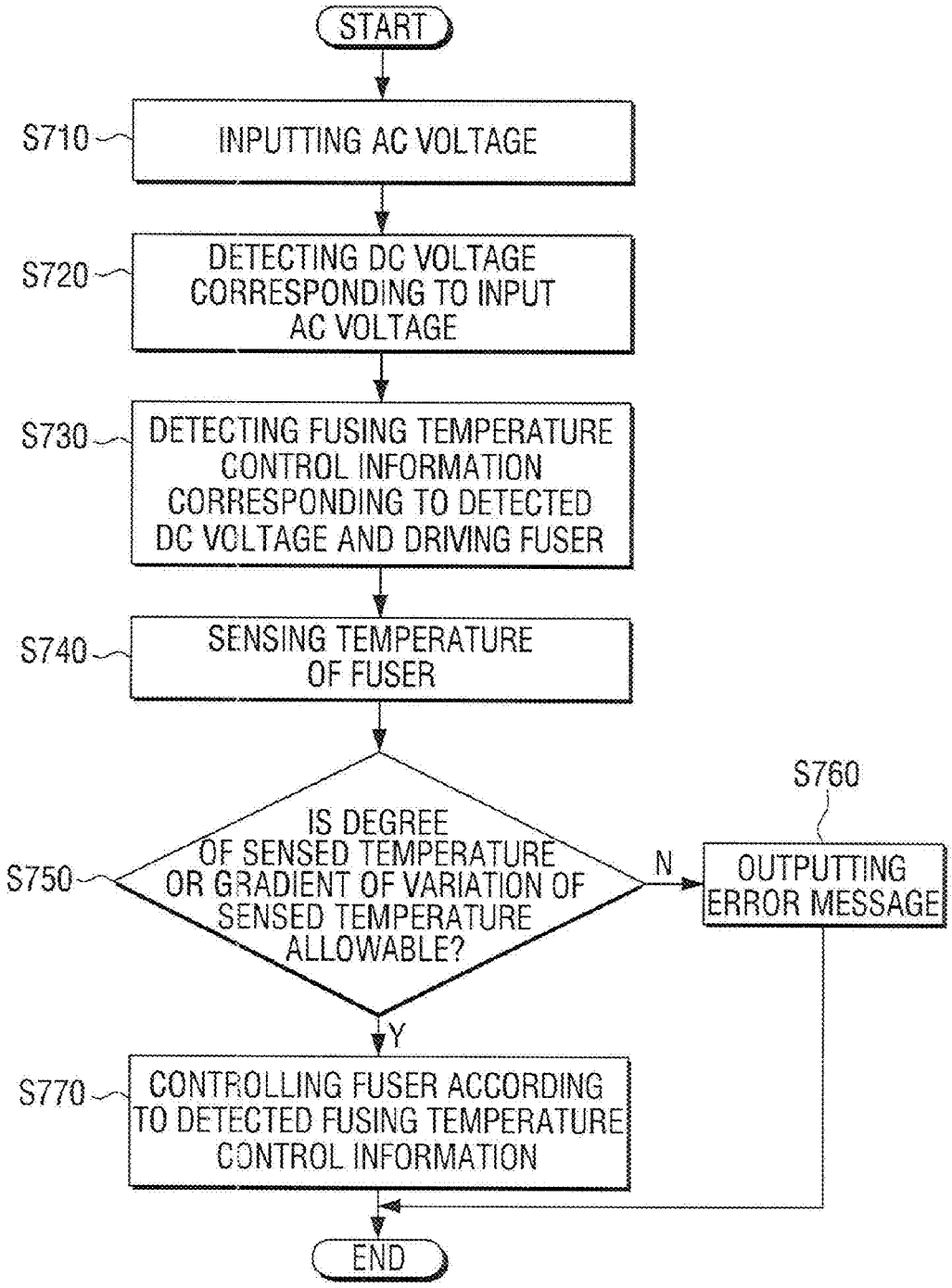
FIG. 7 is a flowchart illustrating a method for controlling a fuser of an image forming apparatus according to another embodiment of the present disclosure.

FIG. 7 is a flowchart illustrating a method for controlling the fuser according to another embodiment of the present disclosure. Referring to FIG. 7, when an AC voltage is input (S710), a DC voltage corresponding to the input AC voltage is detected (S720), and the fusing temperature control information corresponding to the detected DC voltage is obtained (S730). The fuser 120 may be driven according to the detected fusing temperature control information.

The temperature of the driven fuser 120 is sensed by the sensor 160 (S740).

A determination is made whether the sensed temperature or the gradient of the temperature variation is allowable (S750). When the temperature is not allowable, an error message may be output (S760).

When the sensed temperature or the gradient of the temperature variation is allowable, the fuser 120 may be controlled according to the detected fusing temperature control information (S770).

Whether the sensed temperature or the gradient of the temperature variation is allowable or not may be determined based on whether it is less than or greater than the allowable range or the allowable gradient range, respectively, as previously described. Moreover, the sensed temperature or the gradient of the temperature variation is not allowable when it is outside the respective allowable range.

As previously described, in the fuser control method of any of the afore-described embodiments, the DC level of the input AC voltage may be used in diagnosing for the presence or absence of an error of the sensor 160, allowing an improvement in the precision or stability of controlling the fuser 120.

Figure 8:
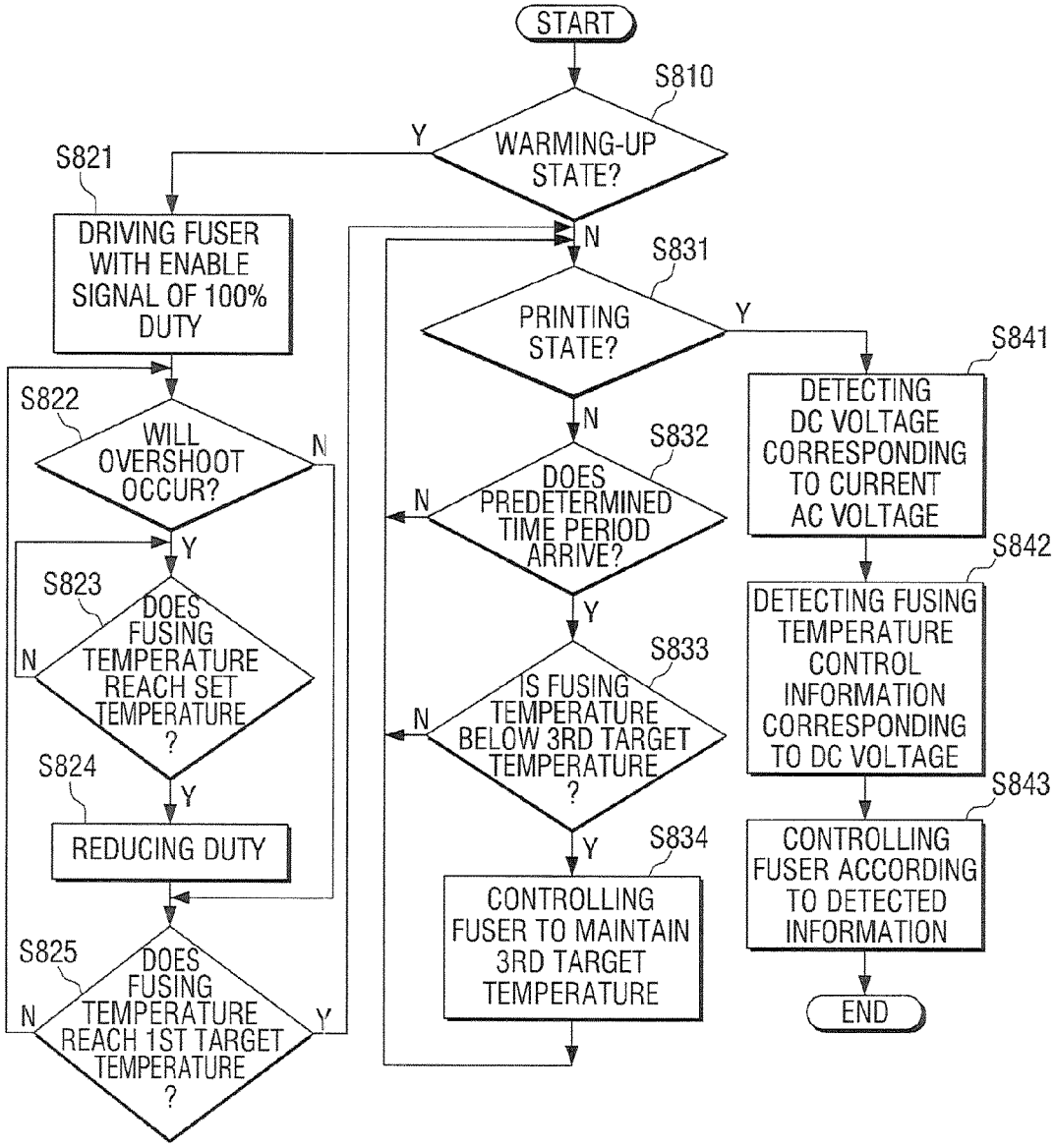
FIG. 8 is a flowchart illustrating an example of the process of controlling a fuser of an image forming apparatus according to yet another embodiment of the present disclosure.

FIG. 8 is a flowchart illustrating a process of controlling the fuser according to an embodiment. Referring to FIG. 8, the fuser 120 may be driven in various ways depending on the state of the image forming apparatus.

If it is determined that the image forming apparatus is presently in the warm-up state (S810:Y), the fuser 120 may be driven with an enable signal having a 100% duty cycle (S821). When the image forming apparatus is turned on in the power-on state, an enable signal having a 100% duty cycle is generally applied to rapidly increase the temperature of the fuser 120. However, this is merely an example. According to some embodiments, the temperature of the fuser 120 may be increased with a duty cycle below 100%, that is, the fuser 120 may be driven with a duty cycle below 100% even in the warm-up state.

When it is predicted that an overshoot will occur during the warming-up operation (S822), the 100% duty cycle may be maintained until the temperature reaches a set temperature (S823), and may be reduced when the temperature reaches the set temperature (S824). In this manner, the overshooting of the target temperature may be prevented from occurring. The process of reducing the duty cycle may be performed in multiple steps.

The image forming apparatus may maintain the warm-up state until the fuser 120 reaches a first target temperature (S825: N).

When the fuser 120 reaches the first target temperature (S825: Y), it may be determined whether a printing operation is to be performed or the standby state is to be maintained (S831).

When the standby state is to be maintained, it may be determined whether a predetermined time period has elapsed (S832). When the predetermined time period has elapsed (S832), it may be determined whether the temperature of the fuser 120 is below a third target temperature (S833). When the time condition and the temperature condition are all satisfied, the fuser 120 may be controlled to maintain the third target temperature (S834). The fuser 120 may be controlled in the standby state in the same way as described above with respect to FIG. 5. That is, the duty cycle of the enable signal may be adjusted stepwise for a predetermined unit time. The unit time, the level of the signal duty cycle, and the time during which each duty is applied may be determined based on the level of the DC voltage corresponding to the input AC voltage.

In the printing state (S831: Y), the DC voltage corresponding to the current AC voltage may be detected (S841).

The fusing temperature control information corresponding to the detected DC voltage is obtained (S842). The fuser 120 may be controlled according to the obtained fusing temperature control information (S843).

As such, the image forming apparatus may control the fuser 120 in the various ways described above according to the operating states. In any one state, the fuser 120 may be controlled based on the DC voltage level corresponding to the level of the input AC voltage, and thus it may be possible to drive the fuser 120 stably. Also, the presence or absence of an error in the sensor 160 may be diagnosed.

While a detailed structure of the controller 150 is not depicted in FIGS. 1 and 2, as would be readily understood by those skilled in the art, the controller 150 may be, e.g., a microprocessor, a microcontroller or the like, that includes a CPU to execute one or more computer instructions to implement the various control operations for the fuser 120 herein described and/or control operations relating to various other components that may be included in an image forming apparatus, and to that end, may further include a memory device, e.g., a Random Access Memory (RAM), Read-Only-Memory (ROM), a flesh memory, or the like, to store the one or more computer instructions.

While the disclosure has been particularly shown and described with reference to several embodiments thereof with particular details, it will be apparent to one of ordinary skill in the art that various changes may be made to these embodiments without departing from the principles and spirit of the invention, the scope of which is defined in the following claims and their equivalents.

What is claimed is:

1. An image forming apparatus, comprising:

an input configured to receive an alternating current (AC) voltage;

a detector having a detector input in operable communication with the input so as to receive the AC voltage therethrough from the input and a detector output through which the detector produces and outputs a direct current (DC) voltage of different level corresponding to a level of the AC voltage;

a fuser configured to receive the AC voltage and to produce heat in accordance with the AC voltage;

a storage having stored therein fusing temperature control information associated with a plurality of DC voltages; and a controller configured to control the fuser using the fusing temperature control information in the storage associated with the DC voltage output by the detector.

2. The image forming apparatus of claim 1, further comprising:

a sensor arranged in proximity of the fuser so as to sense a temperature of the fuser.

3. The image forming apparatus of claim 2, wherein the controller is configured to output a message that indicates an error in the sensor when the temperature of the fuser as sensed by the sensor is outside a pre-determined temperature range associated with the DC voltage detected by the detector or when a gradient of the sensed temperature is outside a pre-determined gradient range associated with the DC voltage.

4. The image forming apparatus of claim 2, wherein the controller is configured to output a message that indicates an error in the sensor when the temperature of the fuser sensed by the sensor is lower than the lower limit of a pre-determined temperature range associated with the DC voltage or when a gradient of the sensed temperature is lower than the lower limit of a pre-determined gradient range associated with the DC voltage, and wherein the controller is configured to control the fuser based on the fusing temperature control information stored in the storage corresponding to the sensed temperature when the sensed temperature is higher than the upper limit of the pre-determined temperature range or when the gradient of the sensed temperature is greater than the upper limit of the pre-determined gradient range.

5. The image forming apparatus of claim 2, further comprising a fusing controller arranged between the input and the fuser so as to selectively transmit the AC voltage from the input to the fuser, wherein the controller is configured to output an enable signal that causes the fusing controller to transmit the AC voltage to the fuser, the controller being further configured to adjust a duty cycle of the enable signal to control the fuser.

6. The image forming apparatus of claim 5, wherein the controller is configured to output the enable signal with a 100% duty cycle until the temperature of the fuser reaches a first target temperature when the image forming apparatus is in a warm-up state.

7. The image forming apparatus of claim 6, wherein, when the AC voltage detected by the detector is greater than a rated voltage, the controller is configured to output the enable signal at the 100% duty cycle until the temperature of the fuser reaches a set temperature that is lower than the first target temperature, and to subsequently reduce the duty cycle of the enable signal in one or more reduction steps until the temperature of the fuser reaches the first target temperature.

8. The image forming apparatus of claim 5, wherein the controller is configured to output the enable signal at a 100% duty cycle until the temperature of the fuser reaches a first target temperature when the image forming apparatus is in a warm-up state, and wherein, when a printing job is to be performed by the image forming apparatus, the controller is configured to output the enable signal at an adjusted duty cycle adjusted according to the fusing temperature control information associated with the DC voltage stored in the storage to maintain the temperature of the fuser substantially at a second target temperature.

9. The image forming apparatus of claim 5, wherein, when the image forming apparatus is in a standby state, the controller is configured to adjust the duty cycle of the enable signal in multiple adjustment steps and to output the enable signal at each adjusted duty cycle respectively resulting from each of the multiple adjustment steps for a unit time duration when the temperature of the fuser decreases below a third target temperature within an elapse of a predetermined time period.

10. The image forming apparatus of claim 9, wherein the controller is configured to adjust according to the DC voltage detected by the detector at least one of respective sizes of the multiple adjustment steps, a total time duration during which the enable signal is output at adjusted duty cycles and the unit time duration during which each adjusted duty cycle is applied.

11. A method of controlling a fuser of an image forming apparatus, comprising:

producing a DC voltage of different level corresponding to a level of an AC voltage input; and controlling the fuser according to pre-stored fusing temperature control information that corresponds to the different level of DC voltage.

12. The method of claim 11, further comprising:

sensing a temperature of the fuser using a sensor;

determining whether the sensed temperature is within a pre-determined range associated with the DC voltage; and outputting a message indicating an error in the sensor when the sensed temperature is outside the pre-determined range.

13. The method of claim 11, further comprising:

sensing a temperature of the fuser using a sensor; and outputting a message indicating an error in the sensor when a gradient of variation in the sensed temperature of the fuser is outside a pre-determined gradient range.

14. The method of claim 11, further comprising:

sensing a temperature of the fuser using a sensor, wherein the step of controlling the fuser comprises:

outputting a message indicating an error in the sensor when the sensed temperature is lower than the lower limit of a pre-determined temperature range associated with the DC voltage or when a gradient of variation of the sensed temperature is lower than the lower limit of a pre-determined gradient range associated with the DC voltage; and controlling the fuser according to the fusing temperature control information that corresponds to the sensed temperature when the sensed temperature is greater than the upper limit of the pre-determined temperature range or when the gradient of variation of the sensed temperature is greater than the upper limit of the pre-determined gradient range.

15. The method of claim 11, wherein the step of controlling the fuser comprises:

adjusting a duty cycle of an enable signal that selectively allows a transmission of the AC voltage input to the fuser.

16. The method of claim 15, wherein the step of controlling the fuser further comprises:

when the image forming apparatus is in a warm-up state, adjusting the duty cycle of the enable signal to be 100% until the temperature of the fuser reaches a first target temperature.

17. The method of claim 15, wherein the step of controlling the fuser further comprises:

when the AC voltage input is greater than a rated voltage, outputting the enable signal at 100% duty cycle until the temperature of the fuser reaches a set temperature lower than a first target temperature, and subsequently reducing the duty cycle of the enable signal in multiple reduction steps until the temperature of the fuser reaches the first target temperature.

18. The method of claim 15, wherein the step of controlling the fuser further comprises:

outputting the enable signal at 100% duty cycle until the temperature of the fuser reaches a first target temperature when the image forming apparatus is in a warm-up state; and adjusting the duty of the enable signal according to the fusing temperature control information associated with the DC voltage to maintain the fuser substantially at a second target temperature when the image forming apparatus is performing a printing job.

19. The method of claim 15, wherein the step of controlling the fuser further comprises:

when the image forming apparatus is in a standby state, adjusting the duty cycle of the enable signal in multiple adjustment steps and outputting the enable signal at each adjusted duty cycle respectively resulting from each of the multiple adjustment steps for a unit time duration when the temperature of the fuser decreases below a third target temperature within an elapse of a predetermined time period.

20. The method of claim 19, wherein, when the image forming apparatus is in a standby state, the step of controlling the fuser further comprises adjusting according to the DC voltage detected by the detector at least one of respective sizes of the multiple adjustment steps, a total time duration during which the enable signal is output at adjusted duty cycles and the unit time duration during which each adjusted duty cycle is applied.

* * * * *